United States Patent [19]

Morse

[11] 4,413,730

[45] Nov. 8, 1983

[54] CARTON-SLIDE CHART

[76] Inventor: Henry C. Morse, 345 Fullerton Pkwy., Chicago, Ill. 60614

[21] Appl. No.: 368,467

[22] Filed: Apr. 14, 1982

[51] Int. Cl.[3] ..... B65D 69/00

[52] U.S. Cl. ..... 206/232; 206/459; 206/467; 206/469; 206/620; 229/16 D

[58] Field of Search ..... 206/232, 467, 468, 469, 206/470, 44 R, 459, 491, 612, 628, 45.29, 457, 621, 626, 631, 620; 229/16 D, 27, 37 R, 68 R, 70, 71, 75

[56] References Cited

U.S. PATENT DOCUMENTS

| | | | |
|---|---|---|---|
| 1,051,607 | 1/1913 | Marsh | 206/459 |
| 2,775,392 | 12/1956 | Frankenstein | 206/45.34 |
| 3,214,075 | 10/1965 | Champlin et al. | 229/16 D |
| 3,219,253 | 11/1965 | Davis | 229/16 D |
| 3,270,946 | 9/1966 | Redpath et al. | 206/612 |
| 3,278,015 | 10/1966 | Berstein | 206/232 |
| 3,302,861 | 2/1967 | Hiersteiner . | |
| 3,442,432 | 5/1969 | Marban | 206/232 |
| 3,467,299 | 10/1969 | Meyer . | |
| 3,902,656 | 10/1975 | Rothchild . | |
| 4,093,117 | 6/1978 | Morse . | |
| 4,132,348 | 1/1979 | Bromberg | 229/75 |
| 4,258,842 | 3/1981 | Falkstein | 206/45.34 |
| 4,344,533 | 8/1982 | Olsen | 206/459 |
| 4,360,106 | 11/1982 | Irvine et al. | 206/470 |

FOREIGN PATENT DOCUMENTS

| | | | |
|---|---|---|---|
| 2226448 | 5/1972 | Fed. Rep. of Germany | 229/27 |

*Primary Examiner*—Joseph Man-Fu Moy

*Assistant Examiner*—David Fidei

*Attorney, Agent, or Firm*—Gerald S. Geren

[57] ABSTRACT

Carton and slide chart formed from one piece of relatively stiff cardboard, in which the slide chart is of the billboard type and extends vertically of the rear wall of the carton, with the slide card between the sections of the end strip of cardboard, bent over to form a slide and glued in this form by a glue strip bent to project vertically of the top of the carton. The slide card is formed by slitting the upper end edge of the glue strip transversely of the carton sheet for a greater portion of the length of the sheet, but leaving a tab retaining the slide card to the slide until used, at which time the slide card is accessible through thumb notches and moved by the fingers along a rail formed by the top of the glue flap to break the tab. The carton is formed from four connected sections of the sheet forming continuations of the slide at one end and of the glue flaps and the slide card at its opposite end.

Alternate of the connected sections have end walls adapted to be bent at right angles to the sections while the other connected sections between the alternate connected sections have glue flaps which may extend between the end walls and be glued thereto by machine after loading of the carton, where the carton is formed and automatically loaded by machine.

The slide and slide card extend vertically of the top wall of the carton and are apertured with the apertured portions registering. The apertured portions form apertures to accommodate the hanging of the carton on a display board.

11 Claims, 5 Drawing Figures

CARTON-SLIDE CHART

BACKGROUND OF THE INVENTION

A prior U.S. Pat. No. 4,093,117 and dated June 6, 1978, was granted to me and discloses and claims a one piece mailer made from relatively stiff cardboard material, with a slide having a slide card movable therealong to form a slide rule and information designating device.

In this envelope, the slide forms one side of the envelope and a mailing flap forms the opposite side of the envelope. Such an envelope has been an attractive item particularly for sales literature but can contain nothing other than letters, sales literature or flat articles and is not suitable for packaged goods and, therefore, in effect is principally an envelope and information designating device on one side of the envelope.

SUMMARY AND ADVANTAGES OF INVENTION

The common subject matter between the device of the present invention and that of my prior U.S. Pat. No. 4,093,117 is that the two articles are made from one piece of cardboard and each have slide charts incorporated as a part thereof in which the slide cards are operable by the breaking of a tab from the one piece of cardboard.

In the present invention, the slide for the slide card is folded over at one end of the strip of cardboard and the folded over pieces are glued to a glue flap inwardly of a slit portion of the board forming the inner margins of the slide card. As previously mentioned, the slide card is connected to the slit portion of the glue flap by a tab which is broken away when the card is to serve as a slide rule type of device and designate certain information in cooperation with windows in the visible wall of the slide and indicia in registery with said windows. The slide and slide card are apertured to be hooked to a hook or the like to suspend the carton from a display board. The end portion of the cardboard strip along which the slide card is slit and glued to the portions forming the slide serves as a rail along which the slide card may move, which assures the registery of the card with the indicia on the slide in alignment with the apertures or windows in the slide.

The slide chart extending upwardly from the back of the carton is of a billboard type and extends vertically of the upper rear corner of the carton, to facilitate the placing of the carton on a display board in a balanced condition and rest against the board in an enticing position for sale.

The slide chart and card strip can be removed without destroying the carton, where it is desired to use the slide chart separate from the carton, or the carton may be so constructed that removal of the slide chart will destroy the carton but not affect the slide chart.

An advantage of the invention is that a carton and billboard type slide chart effective by the breaking of the slide card from the glue flap along which it is slit, by the prospective user is attained from a single sheet of cardboard.

A further advantage of the invention is that the carton and slide chart may be folded from one piece of cardboard in such a manner as to accommodate automatic loading of a product and sealing of the ends of the carton by machine without affecting the slide chart.

A further advantage in the invention is that the carton and slide chart are so arranged that if the slide chart is removed, the carton is not destroyed or damaged.

Another advantage is that the carton may be designed to accommodate various shaped articles, as for example it may be elongated to contain toothpaste or may be shorter and have a larger interior volume to contain bottled vitamins, over the counter drugs and other articles suitable to be placed in displayed cartons, and may be removably suspended by the slide chart, in which the suspension means prevents movement of the slide card relative to the slide chart.

An object of the invention is to provide a carton and billboard slide chart of a one piece construction until loosening of the slide by the user.

A further object of the invention is to provide a carton and slide chart in which the slide chart serves as a suspension means for the carton for display purposes.

A still further object of the invention is to provide a carton and billboard type of slide chart in which the carton may remain intact upon removal of the slide chart therefrom.

These and other objects and advantages of the invention will appear from time to time as the following specification proceeds and with reference to the accompanying drawings wherein.

Figure 1:
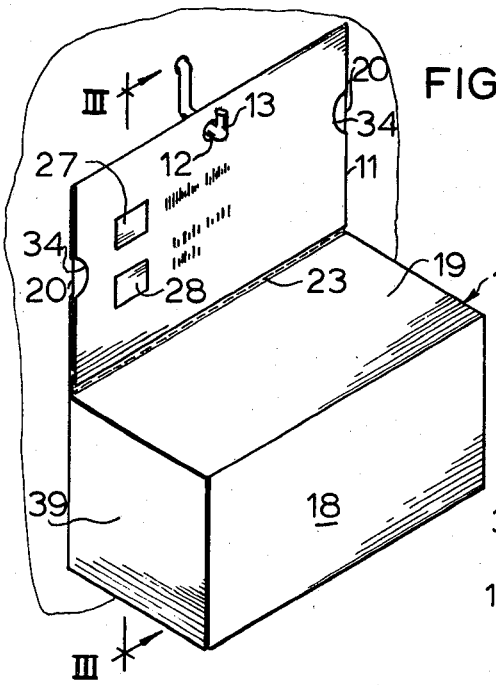
FIG. 1 is a perspective view of a slide chart and carton constructed in accordance with the principles of the present invention.
Figure 2:
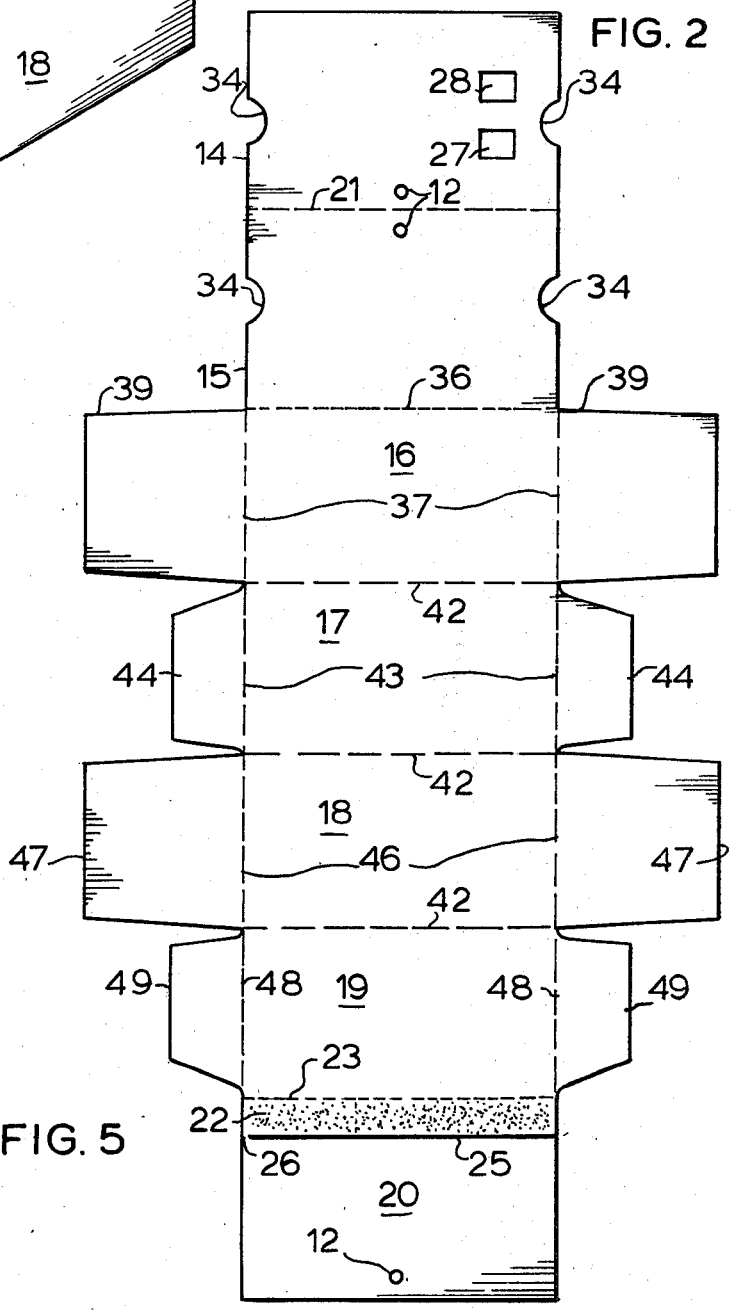
FIG. 2 is a view of a stiff cardboard sheet from which the carton and slide chart of the invention may be formed and illustrating the slide, the four sides of the carton and its ends and glue flaps as well as a glue strip for the carton in which the slide card may extend from one side of the carton.

In the embodiment of the invention illustrated in FIGS. 1 and 2 of the drawings, I have shown a carton 10 having a slide chart 11 of the billboard type extending vertically from one side thereof, herein shown as being the top rear side of the carton. The slide chart has registering hanger receiving apertured portions 12 accommodating the hanging of the slide chart on a display board (not shown), on a hook 13 or other hanger device and adapted to extend through the apertured portions 12 and serve to display the carton on a display board, such as a pegboard or the like board, of a size which will enable a plurality of cartons to be displayed in an attractive manner.

The carton and slide chart are formed from a relatively stiff cardboard sheet shown in FIG. 2 as divided into seven sections 14, 15, 16, 17, 18, 19, and 20. The carton and slide chart may be of 12 point stock or heavier depending upon conditions.

The sections 14 and 15 are folded over each other, along a fold line 21 and cooperate with a glue strip 22 connected with the section 19 by a perforated tear line 23. The section 20 defines a slide card and is slit along the outer edge of the glue strip as indicated by reference numeral 25, for a greater portion of the length thereof to leave a tab 26 at the end thereof opposite its open end.

The section 14 is shown as having a pair of aligned windows 27 and 28 therein, shown as being vertically aligned on above the other and having indicia at one side thereof cooperating with indicia on the slide card formed from the section 20, as will hereinafter more clearly appear as this specification proceeds.

The indicia adjacent the windows 27 and 28 are printed on the slide card may be such as to give educational information, information about the contents of a container packaged in the carton, or dosages to be taken where the container carried within the carton carries medicinal articles, such as tablets or pills. The information may also give household hints, trivia or other records or interesting information when viewed through the spaced windows 27 and 28 on the outside wall of the slide, and the printing on the slide card is in alignment with said windows as the slide card is moved to register the printing thereon with said windows in the manner of a slide rule.

The sections 14 and 15 also have thumb notches 34 in each side thereof to enable the thumb and first finger to grasp the slide card formed by the section 20, and if the tab 26 is not broken, to first break the tab and then move the card to its proper position to indicate the answer to the information on the side 14 of the slide, adjacent the windows 27 and 28.

The wall 16 is defined at its juncture with the wall 15 by score lines 36 enabling the slide chart to be removed from the carton where the carton has no further use and is to be destroyed. The section 16 defining the back wall of the carton also has parallel fold lines 37 at its opposite edges and opposite end carton walls 39, 39 projecting in opposite directions from said fold lines, to form lapping end walls for the carton.

The section 17 forms the front of the carton and is defined by fold lines 42 at its juncture with the sections 16 and 18 and enabling the section 18 to be folded parallel to the section 16 and form the bottom of the carton. The opposite sides of the section 17 have fold lines 43 in alignment with the fold lines 37 and have end flaps 44 which may be glue flaps extending from opposite ends of said section 17 and shorter than the end walls 39 and adapted to be folded inwardly inside of the end walls 29 and glued or otherwise secured thereto, either by an automatic gluing operation or by the application of a pressure sensitive adhesive thereto which may be applied during or preceding the formation of the carton, or by any other securing means, preferably an adhesive securing means.

The section 18 is defined at its juncture with the sections 17 and 19 by fold lines 42. The length of section 18 like the section 16 and 17 is defined by fold lines, herein indicated by reference numeral 46. End walls 47 extend outwardly of the fold lines 46 and are adapted to be folded inwardly along or inside of the end walls 39, to define the ends of the carton.

The section 19 joining the section 18 and forming the top wall of a carton joins the section 18 by fold lines 42 and joins the section 20 by the tear lines 23 which may be perforated, enabling the slide chart to be removed from the carton where the carton is not to be reused and it is desired to have a hand held slide chart. Fold line 48 forming continuations of the fold lines 46, define the ends of the section 19. End flaps 49 extend outwardly of the fold lines 48 and are adapted to be folded inwardly of the end walls 47 and form glue flaps.

The perforations 23 define the end of the section 19. A glue flap 22 extends from the perforations 23 and section 19 in the direction shown in FIG. 2 as downwardly of the perforations 23 and in FIG. 3 as extending upwardly of the perforations 23. A pressure sensitive adhesive or other suitable adhesive may be applied to each side of said glue flap.

Figure 3:
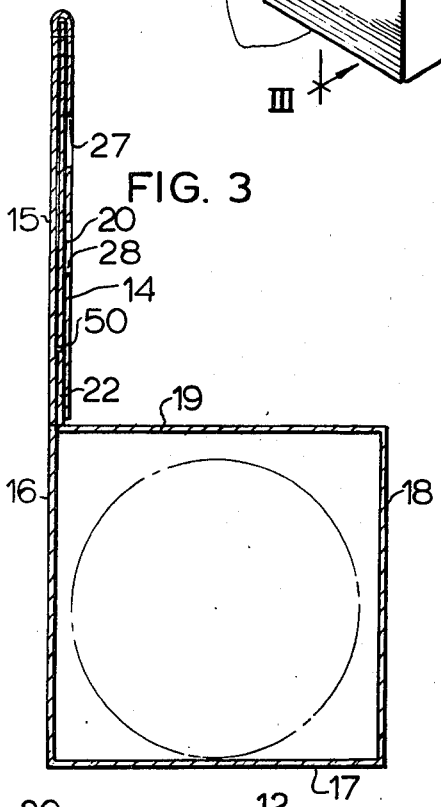
FIG. 3 is a sectional view taken substantially along line III—III of FIG. 1.

The glue flap is bent along the perforations 23 to extend upwardly of and at right angles to the section 19 and terminates along the slit 25 defining the end of the slide card 20, shown in FIG. 2 as the upper end of said slide card and in FIG. 3 as being the lower end of said slide card and slidable along an edge 50 of said glue flap, and formed by the slit 25 upon breaking of the retainer tab 26, as shown in FIG. 3. The edge of the glue flap thus forms a rail or slide along which the slide card may be moved by the fingers of the hand.

With the folding arrangement just described, the slide card 20 will project upwardly of the top 19 as the glue flap is folded about the perforations 23 and along the inside of the slide formed by the space between the inner sides of the sections 14 and 15.

The carton thus described is of a rectangular form open at each end, with the flaps defining the end walls and glue flaps extending therefrom for loading by machine.

When a carton is in the form just described with both ends open, it may readily be stuffed or loaded automatically and then the end flaps 39 and 47 and glue flaps 44 and 49 may be folded to extend along each other with the flaps 39 or 47 on the outside to provide a conventional carton as illustrated in FIG. 1. This may all be done automatically as may be the folding of the carton into an open ended rectangular carton with the billboard slide chart 11 extending thereabove.

It should here be understood that the end of the glue flap 22 defined by the slit 25 forms a bottom rail for the slide card 20 while the tab 26 is readily broken by grasping the slide card through the thumb notches in the slide.

Figure 4:
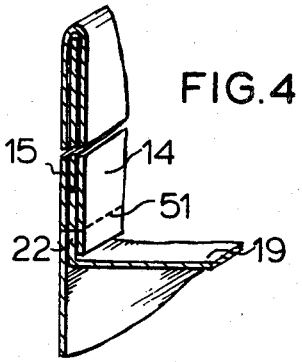
FIG. 4 is a generally sectional view illustrating a modification of the carton, to enable removal of the slide chart without destroying the carton.

In the embodiment of the invention illustrated in FIG. 4, I have shown a modification in which removal of the slide chart does not destroy the carton and is not intended to be removed therefrom.

Figure 5:
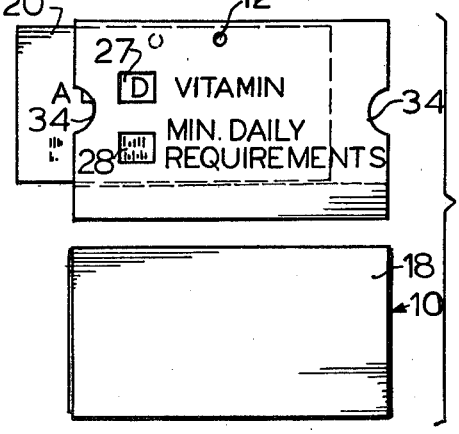
FIG. 5 is a view illustrating the slide chart separated from the carton shown in FIG. 1.

In this form of the invention, the glue flap 22 extends upwardly into the slide a slightly greater distance than the glue flap of FIG. 5 and fold lines (not shown) are provided to define the bottom of the glue flap rather than the perforations 23 shown in FIG. 2. The slide card is slid along the rail formed by the slit separating the carton from the sheet upon breaking of the tab 26 and the section 15 of the slide in effect forms a continuation of the back wall of the carton and is folded over along the slide card to the position shown in FIG. 4. Perforations 51 may extend across the section 15 and mating perforations may extend across the section 14 preferably intermediate the upper end of the glue flap, to accommodate removal of the slide chart without destroying the carton. The slide chart may also be a permanent part of the carton as long as the carton is intact for use.

It should be here understood that while I have shown a relatively short carton, which may be used for a bottle of vitamins or other drugs or articles, that the carton may be elongated to an extent that it may contain a tube of toothpaste or another elongated article. In such a case, the slide may be provided with more than one apertured portion for hanging for display, to retain the carton to extend horizontally or vertically, although one hanger at the center of the billboard slide chart may be used as shown in FIG. 1.

It should be understood from the foregoing that various modifications and variations in the invention may be attained without departing from the spirit and scope of the novel concepts thereof as defined by the claims appended hereto.

I claim as my invention:

1. A carton and billboard type of slide chart comprising a one piece relatively stiff cardboard strip having opposite parallel end edges, said strip being divided into a plurality of longitudinally aligned sections, said sections including four carton forming panel sections intermediate said end edges, two adjacent slide envelope panel sections adjacent one end adapted to be folded over each other and secured at the open end of the folded section, a two sided glue flap and slide panel section at the other end, said two sided glue flap being adjacent a carton forming panel section and positioned intermediate said slide panel section and said carton forming section, and said slide panel section adapted to be folded and interposed between the folded envelope panel sections so that the envelope panel sections and slide panel section form a slide chart, a transverse slit defining an outer margin of said glue flap, said slit stopping short of one end of said glue flap to form a retainer tab retaining the outer of said sections to said glue flap, to extent between said two end sections and accommodate the gluing of said end sections thereto to form a slide, the slit and retainer tab defining a margin of a slide card adapted to be positioned between said first mentioned folded end sections and form a slide card movable along the edge of said glue flap upon the breaking of said tab, the end section of said slide card visible when the carton is in a normal position having indicia thereon cooperating with windows in said slide and indicia on said slide adjacent said windows to give interesting information, which may be educational or refer to the contents of the carton or trivia interesting to the age of the person using the contents of the carton, upon breaking of said tab and moving said slide card along said slide, and four intermediate sections bent at right angles with respect to each other to form a rectangular carton with the glue flap extending vertically of the rear wall portion of the carton between said first mentioned two end sections to glue said end sections in the form of a slide.

2. The carton and slide chart of claim 1 in which the two end sections are defined at the inner end of the innermost of said end sections by perforations extending across said strip and the inner end of said glue flap is defined by perforations extending across said strip to accommodate removal of said slide chart, upon removal of the contents of said carton, when there is no further use for the carton.

3. The carton and slide chart of claim 1 wherein fold lines define the juncture of said glue flap to said carton, to accommodate bending of said glue flap at right angles to the top of the carton to extend vertically therefor and glue said first mentioned end sections in the form of a slide.

4. The carton and slide chart of claim 1 in which the slide and slide card have registering apertured portions at the transverse center line of said slide to accommodate the removable display of said carton.

5. The carton and slide chart of claim 3 in which perforations extend along opposite sides of said slide and glue flap above the top of the carton to enable removal of said slide chart for hand use without destroying the carton.

6. The carton and slide chart of claim 1 wherein the cardboard strip is of a stock of the order of 12 points and the strip is pre-printed prior to forming to its slide chart and carton form.

7. The carton and slide chart of claim 6, wherein the slide and slide card have apertured portions which register prior to the breaking of said tab, and the movement of said slide card along the edge of said glue flap to accommodate the hanging of said slide chart and carton, on a display board and the like, with the slide chart extending vertically and hanging said carton for display purposes.

8. In a carton adapted to be loaded from either end and a billboard type of slide chart integral with the carton and serving as a hanger for the carton for display purposes, a single strip of relatively heavy cardboard opposite sides of which are formed to define the sides of the carton and slide chart, said strip having a plurality of longitudinally aligned carton forming and slide chart forming sections and, including two adjacent end sections defined by a fold line at the juncture of said end sections, and adapted to be folded about said fold line to define the front and back walls of a slide, an opposite end section defining a two-sided glue flap and slide card formed integrally therewith and slit along the edge of the glue flap for a greater portion of the length thereof to define a tab at one end of the slit portion of said glue flap and retaining the opposite end sections defining the slide by gluing of the respective leading and trailing ends of the two adjacent opposite sections to said glue flap, and the other intermediate end sections being foldable to define an open ended carton which may be closed at its ends upon loading of the carton, and with said glue flap being adjacent a carton forming section and being positioned intermediate said carton forming section and said slide card and said slide card adapted to be folded and interposed between the two adjacent end sections so that the adjacent end sections and slide card from said slide chart.

9. The carton and slide chart of claim 8 in which the slide and slide card have aligned apertured portions to accommodate hanging of the slide chart and carton to depend from said apertured portions on a display board and the like, with the slide and slide card extending vertically and the carton extending horizontally and outwardly of the bottom of the slide.

10. The carton and slide chart of claim 9 wherein the innermost side of the slide and the juncture of the glue flap to the carton sections is defined by score lines accommodating separation of the slide card from the carton when it is desired to destroy the carton.

11. The carton and slide chart of claim 8 wherein the innermost side of the slide and the glue flap have score lines defining the inner end of the slide and accommodating removal of the slide chart for use without destroying the carton.

* * * * *